US005860658A

United States Patent [19]

Callahan

[11] Patent Number: 5,860,658

[45] Date of Patent: Jan. 19, 1999

[54] STORAGE RECEPTACLE WITH INTEGRAL HANDLE/STAND

[76] Inventor: Peter Callahan, 25 Everett St., Concord, Mass. 01742

[21] Appl. No.: 624,947

[22] Filed: Mar. 29, 1996

[51] Int. Cl.[6] ..... B60F 57/00

[52] U.S. Cl. ..... 280/30; 280/645

[58] Field of Search ..... 280/30, 645, 643, 280/654, 655.1, 655, 47.33, 47.26, 63; 220/756, 757, 764, 773

[56] References Cited

U.S. PATENT DOCUMENTS

| | | | |
|---|---|---|---|
| 2,745,675 | 6/1956 | Haynes | 280/47.33 |
| 3,371,950 | 3/1968 | Stap | 294/15 |
| 4,059,285 | 11/1977 | McCoy | 280/654 |
| 4,373,737 | 2/1983 | Cory et al. | 280/30 |
| 4,412,697 | 11/1983 | Verde | 294/19.2 |
| 4,461,504 | 7/1984 | Perez et al. | 294/19 A |
| 4,596,414 | 6/1986 | Mottet | 294/19.2 |
| 4,643,317 | 2/1987 | Wilkinson et al. | 294/19 A |
| 5,294,161 | 3/1994 | Stap | 294/19.2 |
| 5,301,991 | 4/1994 | Chen et al. | 294/19.2 |
| 5,368,351 | 11/1994 | Cuti | 294/19.2 |

*Primary Examiner*—Brian L. Johnson
*Assistant Examiner*—Jonathan E. Butts
*Attorney, Agent, or Firm*—Timothy J. Shea, II

[57] ABSTRACT

An object storage receptacle having two articulating arm members movably attached to opposite sides of a receptacle member at a point at or above the center of gravity of said receptacle member. The articulating arm members are attached to the receptacle member such that in a first position the arm members form a handle by which the storage receptacle may be carried, in a second position the arm members form a stand sufficiently stable to support the storage receptacle in a free-standing manner, and in a third position the arm members together may be disposed laterally relative to the storage receptacle. The arm members may be capable of free movement throughout a continuous circle about the receptacle and/or capable of telescoping into a first position where the arm members are fully extended for use and in a second position where the arm members are fully retracted for storage. Wheels may be attached to at least one arm member to enable the user to roll the device to a different location during use without lifting and carrying the entire device.

12 Claims, 6 Drawing Sheets

STORAGE RECEPTACLE WITH INTEGRAL HANDLE/STAND

FIELD OF THE INVENTION

The present invention relates generally to a storage receptacle having two articulating members attached thereto such that in a first position the articulating elements form a handle by which the storage receptacle may be carried, in a second position the articulating elements form a stand sufficiently stable to support the storage receptacle in a free-standing manner, and in a third position the articulating elements together may be disposed laterally relative to the storage receptacle. More particularly, the present invention relates to a household project bucket and a tennis ball hopper.

BACKGROUND OF THE INVENTION

Most household projects require the worker to use a variety of tools and materials during the course of the project. It is desirable to have assembled together in one place before beginning the project all of the tools and materials that are needed to complete the project. In addition to standard toolboxes, which, although easy to carry, are not suitable for many applications, 5-gallon buckets provided with "caddy" inserts are commonly used. However, these buckets are usually placed on the floor, which may require repeated stooping to retrieve tools and/or materials and to return them to the bucket when done. In addition, due to the weight of the tools and materials needed for the project, the bucket may be very difficult and cumbersome to move around as the project progresses.

In a related manner, in order to master the game of tennis, the general recommendation is to perform repetitive drills that simulate actual shotmaking. This requires that a sizable ready supply of balls be kept close at hand. However, merely using a storage bin placed on the court surface is impracticable, as it subjects the player and/or instructor to repeated and strenuous stooping to obtain balls for use in the practice. Further, whether these drills are performed alone, with the aid of an instructor, or with an automatic ball serving machine, a large number of tennis balls end up strewn about the court during the course of such practice. To retrieve all of these balls also requires repeated and strenuous stooping. This situation led to the development of ball retrieval and storage devices to minimize this labor.

A typical ball retrieval and storage device is disclosed in U.S. Pat. No. 3,371,950 to Stap entitled "TENNIS BALL RETRIEVER AND STORAGE UNIT" and issued 5 Mar. 1968. The '950 device includes a roughly cube-shaped ball receptacle having U-shaped rigid arm members movably attached in parallel to opposite sidewalls of the receptacle. The U-shaped arm members serve in an upright position as a standard for the receptacle and in an inverted position as a handle for the receptacle. The receptacle has a bottom formed from a plurality of parallel rods spaced apart from one another slightly less than the diameter of the balls to be retrieved, so that a tennis ball may be squeezed between the bars to gain entry into the receptacle. To retrieve a tennis ball from the court surface without stooping to pick it up manually, a person carrying the receptacle by the handle formed when the U-shaped arm members are brought into the inverted position presses the receptacle bottom against the tennis ball resting on the court to automatically squeeze the balls into the receptacle.

A modification of the '950 device is described in U.S. Pat. No. 4,412,697 to Verde entitled "TENNIS BALL RETRIEVING STORAGE CONTAINER" and issued 1 Nov. 1983.

The '697 device merely comprises the separation of the plurality of parallel rods forming the bottom of the receptacle to a distance slightly more than the diameter of the balls to be retrieved and the addition of freely rotating hollow, cylindrical tubular rollers axially journaled about the parallel rods such that the distance between inside surfaces of adjacent parallel rollers is slightly less than the diameter of the balls to be retrieved.

Other known devices modify this concept. For example, U.S. Pat. No. 5,368,351 to Cuti, entitled "TENNIS BUTLER" and issued 29 Nov. 1994, and U.S. Pat. No. 5,294,161 to Stap, entitled "TENNIS BALL RETRIEVING AND STORING DEVICE" and issued 15 Mar. 1994, both show a receptacle having a handle/standard member or members such that the receptacle can be used to retrieve and store tennis balls. In addition, rolling carts capable of picking up tennis balls are shown in U.S. Pat. No. 4,461,504 to Perez et al. entitled "TENNIS BALL RETRIEVER AND CARRIER" and issued 24 Jul. 1984 and U.S. Pat. No. 5,301,991 to Chen et al. entitled "TENNIS BALL RETRIEVER AND STORAGE CART" and issued 12 Apr. 1994.

These and other currently known tennis ball retrievers have several disadvantages. First, because they are constructed entirely or substantially from metal or other dense materials, these devices are usually quite heavy, even when empty. Second, because the arm members used to form a handle and a standard, depending upon their position, are restricted in their movement, the devices are awkward to move when full. Third, the known devices occupy a large volume of space, due chiefly to the area occupied by the arm members. Although the arm members of several of the known devices are removable, it is inconvenient to have to disassemble the unit in order to store it, only to have to reassemble the unit for its next use.

Accordingly, it is an object of this invention to overcome the above illustrated inadequacies and problems of extant devices by providing an object storage receptacle that is lightweight, simple to use, and easy to store.

It is another object of this invention to provide an object storage receptacle having arm members capable of free movement throughout a continuous circle about the receptacle.

It is a further object to provide an object storage receptacle having arms capable of telescoping into a first position where the arm members are fully extended for use and in a second position where the arm members are fully retracted for storage.

It is another object of this invention to provide an object storage receptacle having wheels attached to at least one arm member to enable the user to roll the receptacle to a different location during use without lifting and carrying the entire receptacle.

SUMMARY OF THE INVENTION

The foregoing objects are met by an object storage receptacle having two articulating arm members movably attached to opposite sides of a receptacle member at a point at or above the center of gravity of said receptacle member. The articulating arm members are attached to the receptacle member such that in a first position the arm members form a handle by which the storage receptacle may be carried, in a second position the arm members form a stand sufficiently stable to support the storage receptacle in a free-standing manner, and in a third position the arm members together may be disposed laterally relative to the storage receptacle.

Other objects, features and advantages will be apparent from the following detailed description of preferred embodiments thereof taken in conjunction with the accompanying drawings in which:

DETAILED DESCRIPTION OF PREFERRED EMBODIMENTS

Figure 1B:
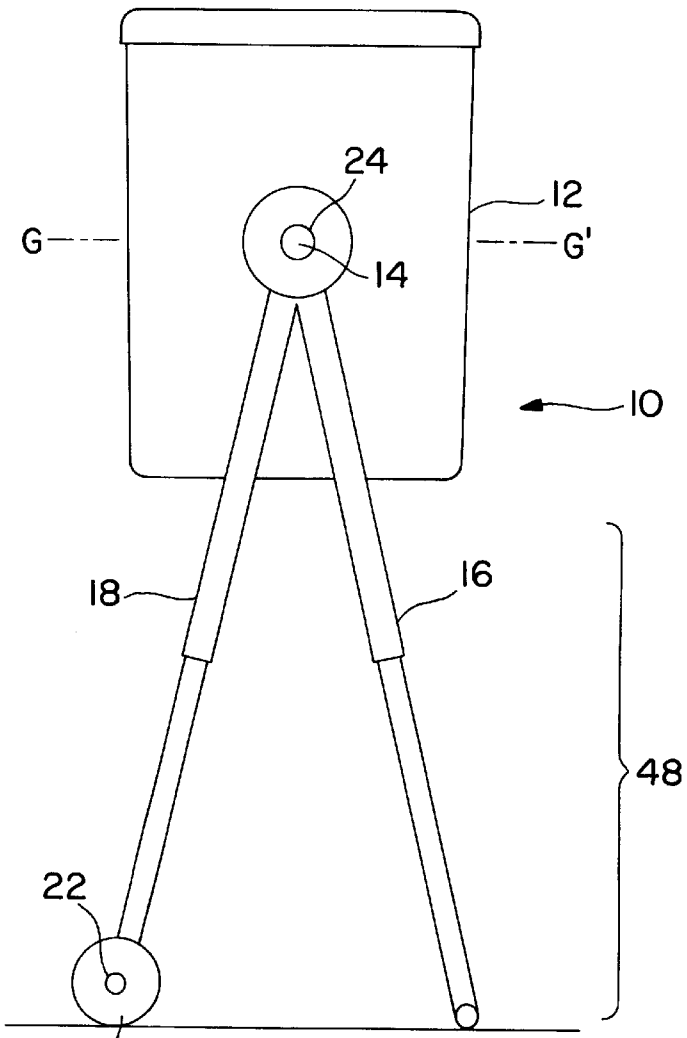
FIG. 1B is a side elevation of the object storage receptacle of FIG. 1A.
Figure 1A:
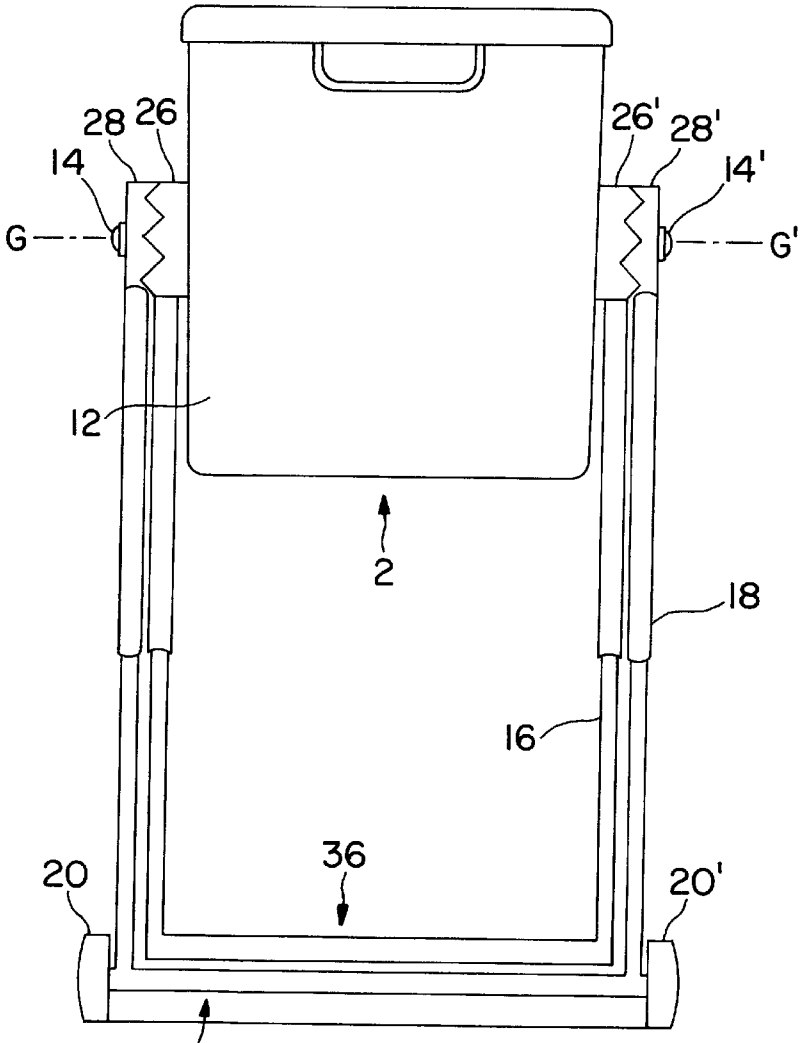
FIG. 1A is a front elevation of an object storage receptacle of the present invention wherein the arm members are disposed in a first position intended for use as a ball stand during use.

In its simplest form, as shown in FIGS. 1–5, the present invention comprises an object storage receptacle 10 having a receptacle member 12, a U-shaped inner articulating arm member 16 and U-shaped outer articulating arm member 18, each of which has an open first end and a closed second end 36 and 38, respectively, receptacle member 12 movably attached to the open ends of U-shaped inner articulating arm member 16 and U-shaped outer articulating arm member 18 via axial connectors 14 and 14'. (It is understood for the purposes of this discussion that object storage receptacle 10, inner articulating arm member 16, and outer articulating arm member 18 are bilaterally symmetrical. Accordingly, where reference is made to axial connector 14, attachment brackets 26 and 28, central connector channel 24, and wheel 20, these are found on each side of the inner and outer U-shaped articulating arm members 16 and 18, respectively, as shown in FIG. 1A.)

The open first ends of each of inner and outer articulating arm members 16 and 18 terminate in attachment brackets 26 (26') and 28 (28'), respectively. Each of attachment brackets 26 (26') and 28 (28') define a central connector channel 24 (24'). Axial connector 14 (14') is disposed through central connector channel 24 (24') and fixably contacts receptacle member 12 at or above the center of gravity of said receptacle member 12, as defined by line G—G'.

Figure 11:
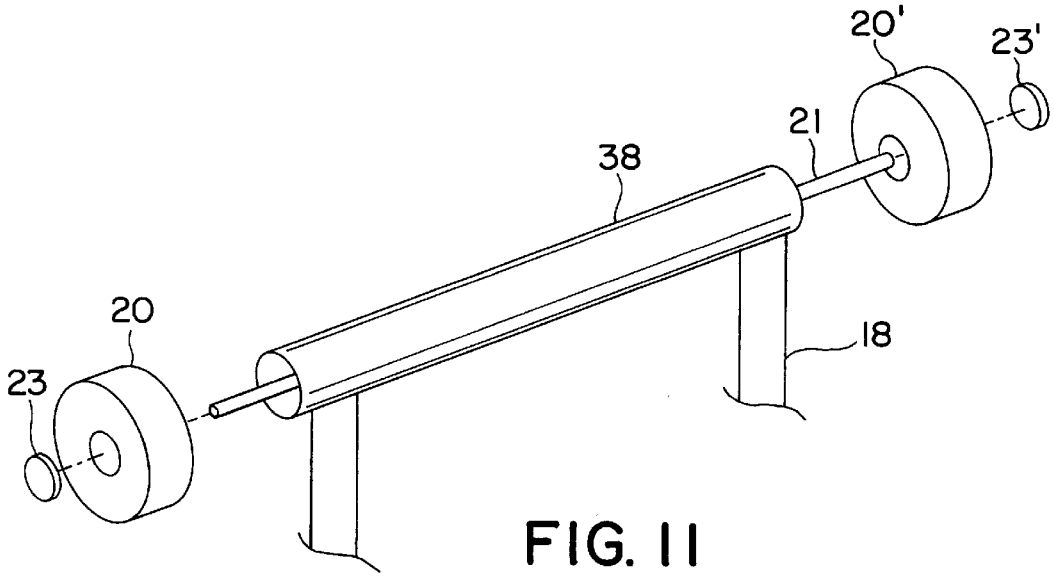
FIG. 11 is a breakout view of one embodiment of the outer articulating arm member.

Closed second end 38 of outer articulating arm member 18 is a transverse member having extension segments 22 (22'). Wheels 20 (20') may be rotatably disposed about extension elements 22 (22'). Alternately, as shown in FIG. 11, closed second end 38 may be tubular and have journaled therein an axle member 21 around which wheels 20 (20') may be rotatably disposed. Hub elements 23 (23') could then secure wheels 20 (20') to axle element 21.

Figure 6:
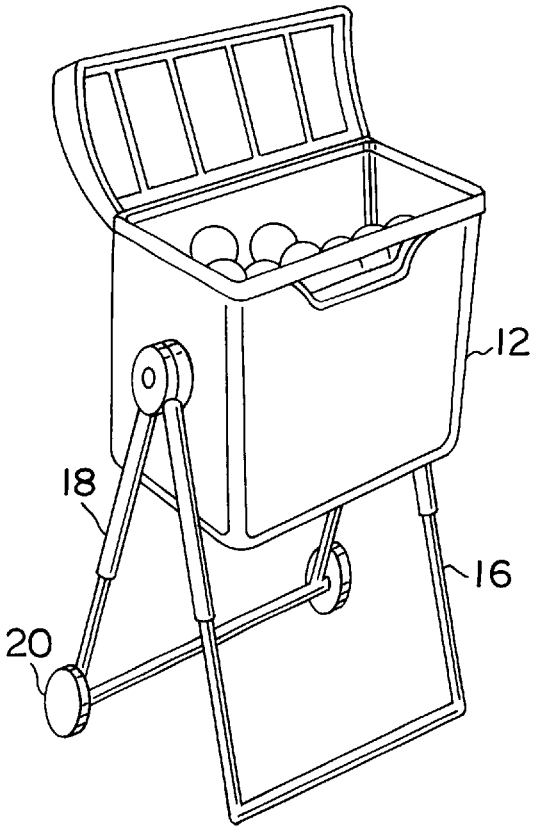
FIG. 6 is a perspective view of the object storage receptacle of the present invention in the first position of FIG. 1.

Inner and outer articulating arm members 16 and 18, respectively, are attached to the receptacle member 12 such that, in a first position, shown in FIGS. 1, and 6, the inner and outer articulating arm members 16 and 18 form a stand 48 sufficiently stable to support the receptacle member 12 in a free-standing manner. In a second position, shown in FIGS. 2, 4, 7, and 9, the inner and outer articulating arm members 16 and 18 form a handle 46 by which the object storage receptacle 10 may be carried and used to retrieve tennis balls from a court surface. In a third position, as shown in FIGS. 3 and 8, the closed second end 36 of inner articulating arm member 16 is disposed above the receptacle member 12, while the closed second end 38 of outer articulating arm member 18 is disposed below the receptacle member 12, so that closed second end 36 can be used as a handle to roll receptacle member 12 across a surface, such as a floor or a tennis court, on wheels 20 (20') rotatably disposed about extension elements 22 (22') of closed second end 38 or axle member 21 journaled therein. Finally, in a fifth position, shown in FIGS. 5 and 10, the articulating arm members 16 and 18 together may be disposed laterally relative to the receptacle member 12, to permit easy storage, as in an automobile trunk.

Figure 2B:
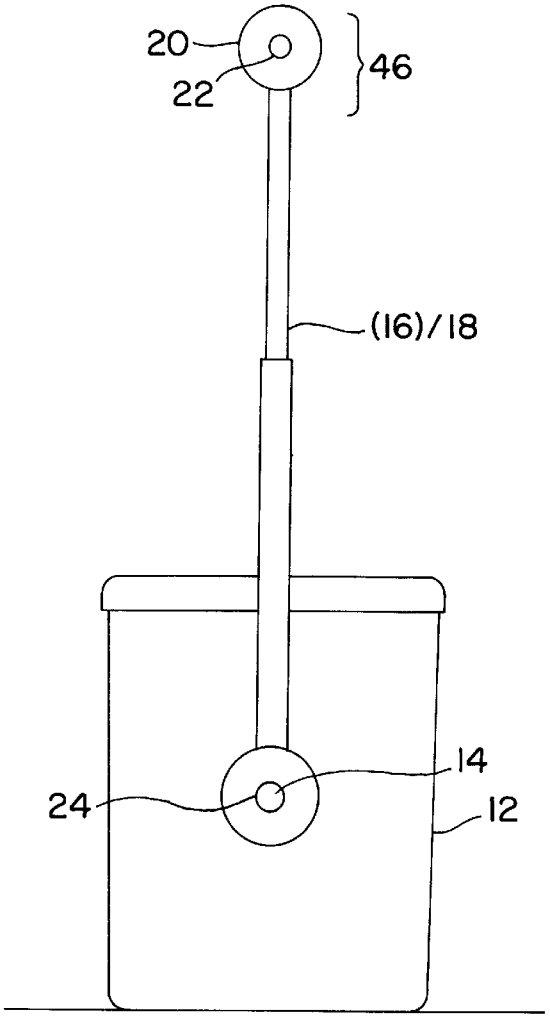
FIG. 2B is a side elevation of the object storage receptacle of FIG. 2A.
Figure 2A:
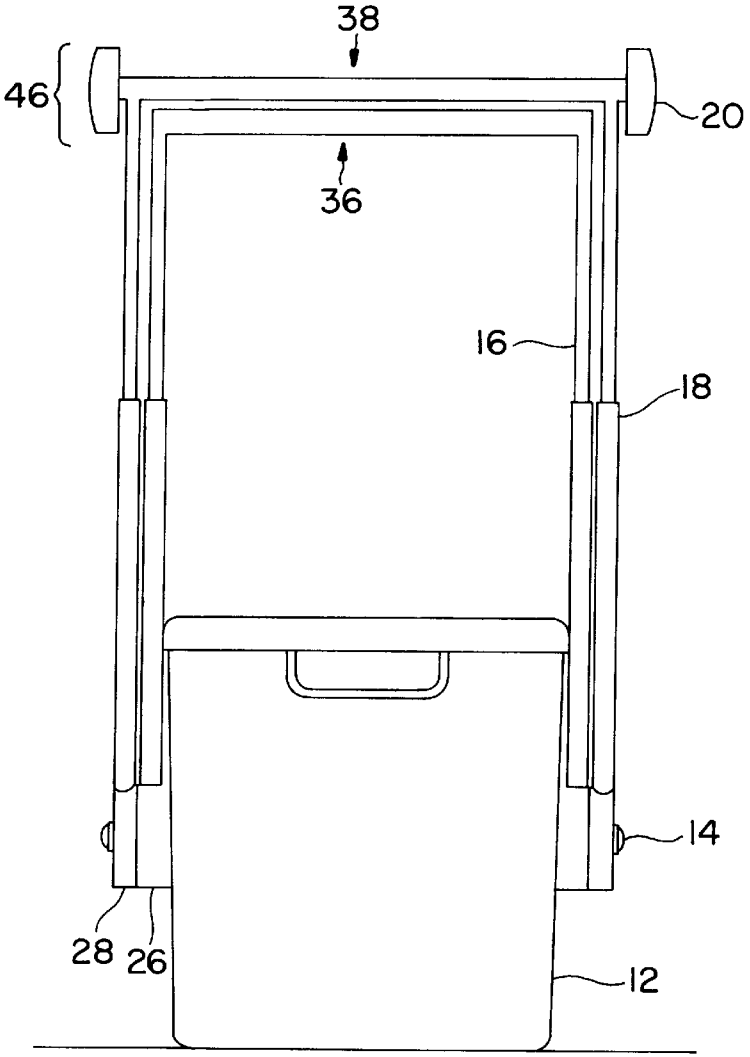
FIG. 2A is a front elevation of an object storage receptacle of the present invention wherein the arm members are disposed in a second position intended for carrying the receptacle to a desired location and/or use as a ball retriever during a tennis practice.
Figure 5:
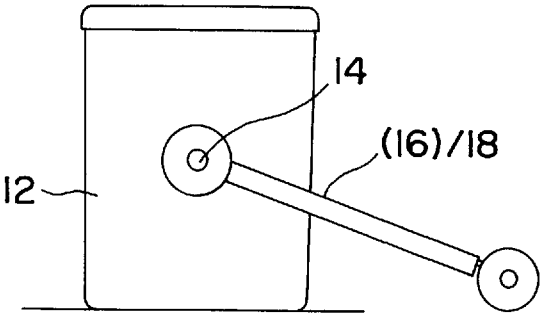
FIG. 5 is a side elevation of an object storage receptacle of the present invention wherein the arm members are disposed in a fifth position intended for storing the receptacle.
Figure 4:
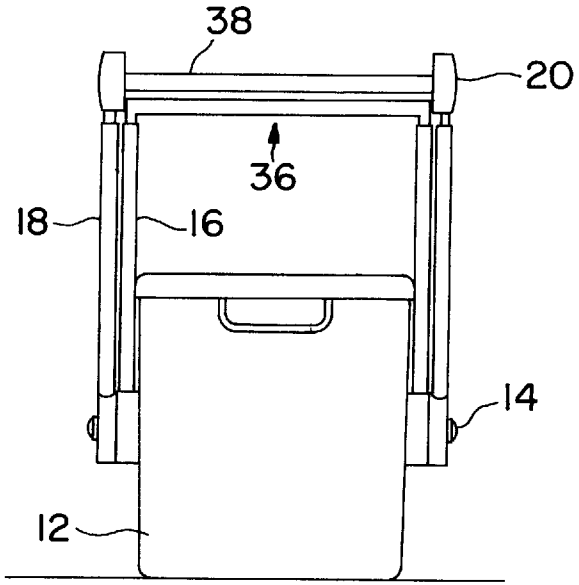
FIG. 4 is a front elevation of an object storage receptacle of the present invention wherein the arm members are disposed in a retracted fourth position intended for use in carrying the receptacle to a desired location.
Figure 3:
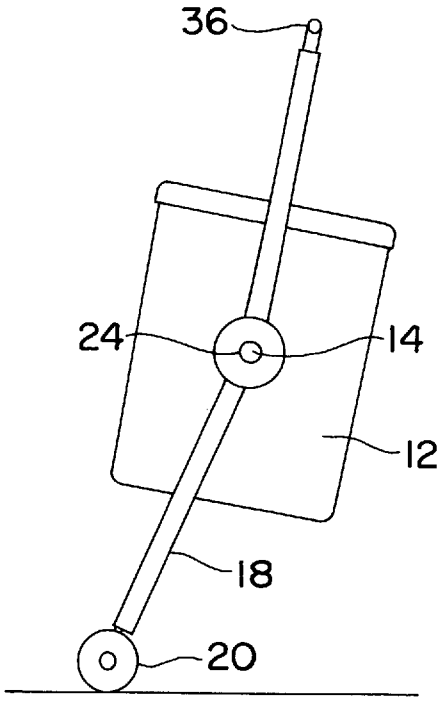
FIG. 3 a side elevation of an object storage receptacle of the present invention wherein the arm members are disposed in a third position intended for rolling the receptacle across a surface to a desired location.
Figure 7:
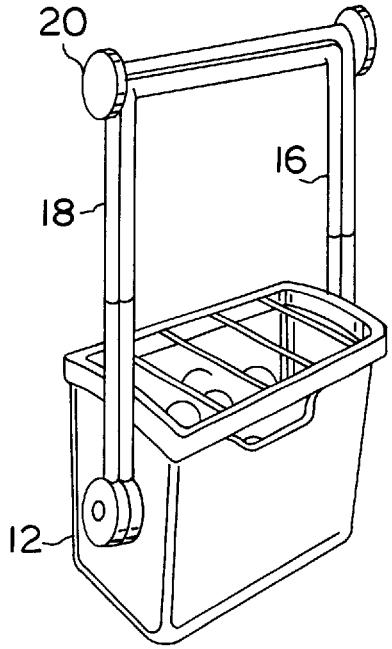
FIG. 7 is a perspective view of the object storage receptacle of the present invention in the second position of FIG. 2.
Figure 8:
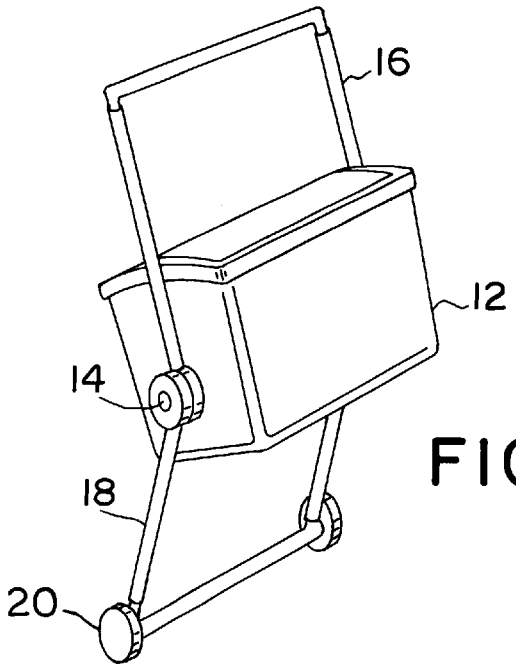
FIG. 8 is a perspective view of the object storage receptacle of the present invention in the third position of FIG. 3.
Figure 9:
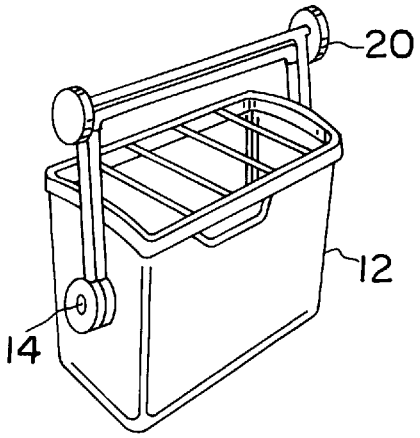
FIG. 9 is a perspective view of the object storage receptacle of the present invention in the fourth position of FIG. 4.
Figure 10:
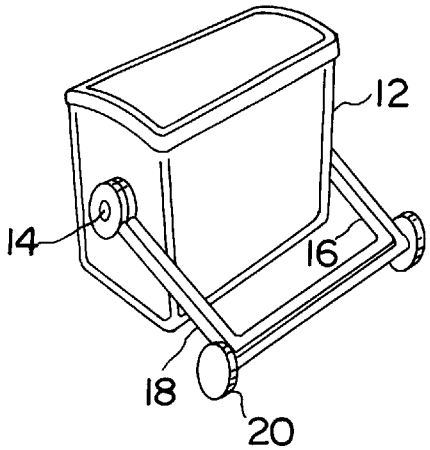
FIG. 10 is a perspective view of the object storage receptacle of the present invention in the fifth position of FIG. 5.

Inner and outer articulating arm members 16 and 18, respectively, may telescope from a first, extended position, shown in FIGS. 2 and 7, to a second, retracted position, shown in FIGS. 4 and 9. Optional locking means may secure inner and outer articulating arm members 16 and 18, respectively, in the first or second position.

Attachment brackets 26 (26') and 28 (28') may be provided with locking means, such as correspondingly toothed faces, as shown in FIG. 1, such that articulating arm members 16 and 18 may be rotated about axial connector 14 (14') to a new position, yet remain in that position without rotational slippage. In this way, when articulating arm members 16 and 18 are positioned to form stand 48, they are capable of supporting the weight of receptacle member 12 in a stable manner. Other conventional means of preventing rotational slippage, yet allowing stepwise rotational movement of articulating arm members 16 and 18, e.g., ratchets, may be used.

Figure 12:
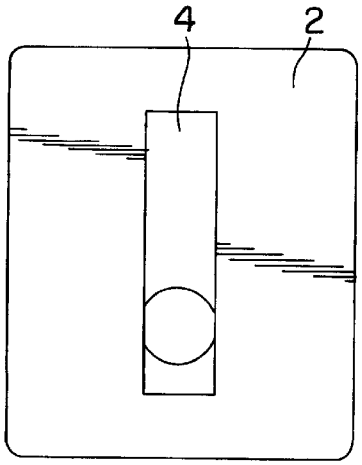
FIG. 12 is a plan view of the bottom of one embodiment of the object storage receptacle of the present invention intended for use as a tennis ball hopper.

In one embodiment, intended for use as a tennis ball storage and retrieval device, shown in FIG. 12, receptacle member 12 has a bottom wall 2 defining at least one aperture 4 such that at least one aperture 4 is slightly narrower than the width of a used tennis ball. To retrieve a tennis ball laying on the court surface, object storage receptacle 10 is positioned such that at least one aperture 4 is above the ball. The ball is then forced through at least one aperture 4 and into receptacle member 12 when the user applies downward pressure to handle 46.

Figure 13:
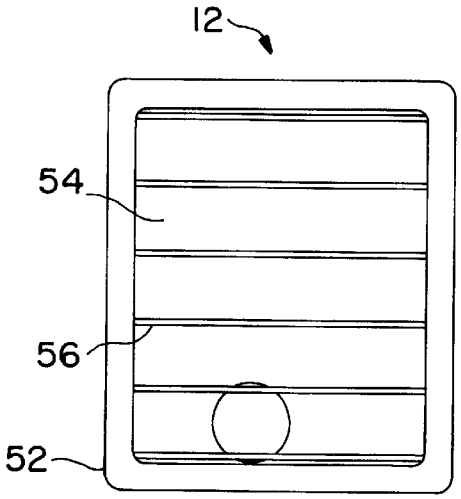
FIG. 13 is a plan view of the bottom of a second embodiment of the object storage receptacle of the present invention intended for use as a tennis ball hopper.

In an alternate embodiment, shown in FIG. 13, receptacle member 12 has a bottom lip 52 defining an aperture 54. In this embodiment, receptacle member 12 has a plurality of rod members 56 disposed in parallel across aperture 56 at a separation distance slightly less than the diameter of a used tennis ball. Thus, to retrieve a tennis ball laying on the court surface, object storage receptacle 10 is positioned such that aperture 54 is above the ball. The ball is then forced through rod members 56 and into receptacle member 12 when the user applies downward pressure to handle 46.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. An object storage receptacle comprising:

a) a substantially rigid, nonfoldable receptacle member having a bottom wall and one or more side walls essentially orthogonal thereto defining an enclosure with a center of gravity within the enclosure;

b) means for holding the receptacle member disposed at opposed portions of its at least one wall at or above said center of gravity and wherein said means for holding are constructed and arranged as rotatable mounts with an axis defined therebetween allowing the receptacle to gimbal freely about said axis, and c) further comprising means for transporting the receptacle comprising two U-shaped, articulating arm members, each arm member having an open end defined by two lateral segments, each having a terminal point at said open end, and a closed end defined by a transverse segment, wherein said articulating arm members are rotatably attached at said terminal points to said means for holding such that said articulating arm members may revolve about said receptacle member in a 360° arc.

2. The object storage receptacle of claim 1, wherein in a first position said arm members form a handle by which said storage receptacle may be carried.

3. The object storage receptacle of claim 2, wherein in a second position said arm members form a stand sufficiently stable to support said storage receptacle in a free-standing manner.

4. The object storage receptacle of claim 3, wherein in a third position a first said arm member is disposed above said receptacle member, while a second said arm member has wheels rotatably disposed thereby said transverse segment and said second arm member is disposed below said receptacle member, so that said first arm member can be used as a handle to roll said receptacle member across a surface.

5. The object storage receptacle of claim 4, wherein in a fourth position said articulating arm members together may be disposed laterally relative to said receptacle member, to permit easy storage, as in an automobile trunk.

6. The object storage receptacle of claim 1, wherein said articulating arm members are attached to said receptacle member such that rotational slippage of each of said arm members relative to said receptacle member and other said arm member is prevented, yet stepwise rotational movement of each of said arm members about said attachment point is allowed.

7. The object storage receptacle of claim 4, wherein said wheels are rotatably disposed about extension elements formed from said transverse segment of said second arm member.

8. The object storage receptacle of claim 4, wherein said transverse segment of said second arm member is of tubular construction and said wheels are rotatably disposed about an axle member journaled in said tubular transverse segment, said wheels being secured to said axle member by hub elements.

9. The object storage receptacle of claim 1, wherein said two articulating arm members comprise nested lateral segments that may telescope from a first, extended position to a second, retracted position.

10. The object storage receptacle of claim 9, wherein said two articulating arm member nested lateral segments may be secured in a position selected from the group consisting of said first, extended position, said second, retracted position, and intermediate positions therebetween by locking means disposed such that they achieve this function.

11. The object storage receptacle of claim 1, wherein said receptacle member bottom wall defines at least one aperture having a width slightly less than the width of a used tennis ball.

12. The object storage receptacle of claim 1, wherein said receptacle member bottom wall comprises a bottom lip defining an aperture capable of accommodating a plurality of rod members disposed in parallel across said aperture at a separation distance slightly less than the diameter of a used tennis ball.

* * * * *